US009062551B2

(12) United States Patent
Simonet

(10) Patent No.: US 9,062,551 B2
(45) Date of Patent: Jun. 23, 2015

(54) SEALING DEVICE FOR ROTATING TURBINE BLADES

(75) Inventor: Christophe Simonet, Ennetbaden (CH)

(73) Assignee: ALSTOM TECHNOLOGY LTD, Baden (CH)

( * ) Notice: Subject to any disclaimer, the term of this patent is extended or adjusted under 35 U.S.C. 154(b) by 506 days.

(21) Appl. No.: 13/426,704

(22) Filed: Mar. 22, 2012

(65) Prior Publication Data

US 2012/0243977 A1 Sep. 27, 2012

(30) Foreign Application Priority Data

Mar. 25, 2011 (CH) ..... 0545/11

(51) Int. Cl.

| | |
|---|---|
| ***F01D 11/08*** | (2006.01) |
| ***F01D 9/04*** | (2006.01) |
| ***F01D 11/00*** | (2006.01) |
| ***F01D 11/02*** | (2006.01) |
| ***F01D 25/24*** | (2006.01) |

(52) U.S. Cl.

CPC ..... *F01D 9/041* (2013.01); *F01D 11/001* (2013.01); *F01D 11/02* (2013.01); *F01D 25/246* (2013.01)

(58) Field of Classification Search

CPC ..... F04D 11/14; F04D 11/16; F01D 9/041; F01D 25/246; F01D 11/001; F01D 11/02

USPC ..... 415/173.3, 173.2, 171.1, 126, 173.5, 415/170.1, 173.1, 209.2

See application file for complete search history.

(56) References Cited

U.S. PATENT DOCUMENTS

| | | | | |
|---|---|---|---|---|
| 3,501,246 | A | 3/1970 | Hickey | |
| 4,326,835 | A * | 4/1982 | Wertz | 416/193 A |
| 5,080,557 | A * | 1/1992 | Berger | 415/173.3 |
| 5,501,573 | A | 3/1996 | Sanders | |
| 5,715,596 | A | 2/1998 | Bintz | |
| 6,131,910 | A | 10/2000 | Bagepalli | |
| 6,547,522 | B2 * | 4/2003 | Turnquist et al. | 415/173.3 |
| 7,229,246 | B2 * | 6/2007 | Ghasripoor et al. | 415/173.3 |

(Continued)

FOREIGN PATENT DOCUMENTS

| | | |
|---|---|---|
| CN | 1550643 A | 12/2004 |
| DE | 3027712 A | 5/1981 |

(Continued)

OTHER PUBLICATIONS

Hans Reuschke: "Spezielle Konstruktionsaufgaben aus dem AEG-Grossturbinenbau", p. 85-94.

(Continued)

*Primary Examiner* — Dwayne J White
*Assistant Examiner* — Jason Fountain
(74) *Attorney, Agent, or Firm* — Buchanan Ingersoll & Rooney PC

(57) ABSTRACT

A seal for reducing a fluid flow around tips of rotating blades of a turbine includes a plurality of diaphragms disposed in succession and providing an outer support for a radial arrangement of static blades disposed alternatingly with the rotating blades in an axial direction. An outer seal has axial and radial supports. The radial support includes a ring held in position by a key and a circumferential extension of the ring. The key and the circumferential extension have a clearance so as to allow a relative radial movement between the ring and a part of a casing or the plurality of diaphragms and providing a pressure sealing face and support in the axial direction.

12 Claims, 4 Drawing Sheets

(56) References Cited

U.S. PATENT DOCUMENTS

| | | | | |
|---|---|---|---|---|
| 7,645,117 | B2 | 1/2010 | Bracken et al. | |
| 2002/0150469 | A1* | 10/2002 | Bolms | 415/115 |
| 2004/0096319 | A1 | 5/2004 | Uchida | |
| 2004/0223844 | A1 | 11/2004 | Farrell et al. | |
| 2006/0133928 | A1 | 6/2006 | Bracken et al. | |
| 2010/0031671 | A1 | 2/2010 | Chehab et al. | |
| 2010/0232941 | A1 | 9/2010 | Smoke et al. | |
| 2010/0239414 | A1* | 9/2010 | Tesh et al. | 415/173.7 |

FOREIGN PATENT DOCUMENTS

| | | | |
|---|---|---|---|
| DE | 69105712 | T2 | 4/1995 |
| DE | 102007020863 | A1 | 11/2007 |
| EP | 0382333 | A1 | 8/1990 |
| JP | H09264104 | A | 10/1997 |
| JP | 2007321721 | A | 12/2007 |
| WO | WO 2008081485 | A1 | 7/2008 |

OTHER PUBLICATIONS

European Patent Office, Search Report in European Patent Application No. 08715146.0 (Apr. 16, 2010).

German Patent Office, Search Report in German Patent Application No. 10 2012 005 771.7 (Apr. 26, 2013).

First Office Action issued on Aug. 26, 2014, by the State Intellectual Property Office of the People's Republic of China in Chinese Patent Application No. 201210093826.8, and an English translation of the Office Action. (11 pages).

* cited by examiner

SEALING DEVICE FOR ROTATING TURBINE BLADES

CROSS REFERENCE TO PRIOR APPLICATIONS

Priority is claimed to Swiss Application No. CH 00545/11, filed on Mar. 25, 2011 in Switzerland, the entire disclosure of which is incorporated by reference herein.

FIELD OF THE INVENTION

The present invention relates to an improved sealing device.

BACKGROUND OF THE INVENTION

In the following description the term "turbine" is used to refer to rotary engines having a rotating part and a stator part force coupled by a fluid medium such as water or gas. Of particular interest for the present invention are axial turbines comprising radially arranged fixed stator blades or vanes alternating with radially arrangements of moving rotor blades. Movements are generally defined as movements relative to a casing or housing.

A common problem encountered in the design and operation of turbines is the leakage between the tips of the rotor blades or any circumferential shroud attached to them and the housing. The operation of a radial turbine requires a minimum of tip clearance between the rotating blades and the stationary wall of the casing or any extensions thereof. The gap, however, gives rise to a leakage flow, which is driven by the pressure difference between the pressure side and the suction side.

To reduce tip leakage the gap between the rotating parts and the static parts by appropriate seals may be closed. The most common type of seal used for this purpose is the labyrinth seal. A labyrinth seal has typically a number of radially extending annular knives on one part and a corresponding annular seal land on the other part or an arrangement of threads or grooves. All types of labyrinth seals have the common feature of providing a tortuous path for the fluid through the gap. For the purpose of preventing tip leakage in a turbine, the seal often takes the shape of a complete ring usually assembled as halves or segments within and supported by the casing.

As labyrinth seals are used in designs of turbine manufacturers, it suffices for the purpose of the present invention to emphasize that such seals are complex shapes, which have to be machined to exacting tolerances in order to function properly. Any movement of the parts of the seal from their default positions during operation generates usually a significant increase in leakage or friction between the moving and the static part. Known labyrinth seals for rotating blades have been integrated into the inner casing of a turbine as well as into diaphragm structures or ring-shaped carriers.

To accommodate relative movement of the parts of the seal in case of a radial expansion or shrinkage of the rotating parts, some seals are assembled as spring-backed packages. In a spring-backed seal, the elastic force pushes one part of the seal against the other and thus avoids widening gaps or excessive friction. For example, the AEG document Title: "Spezielle Konstruktionsaufgaben aus dem AEG-Grossturbinenbau" by Hans Reuschke (DK 621.165-181.2: 62.0022) describes in the section "Wellendichtung", pp. 90-91, spring-backed rings supporting a seal between diaphragms.

Alternatives to the labyrinth seals are brush seals and finger seals. These types of seals include generally a plurality of flexible members mounted on one part and sealingly engaging a suitable surface on the other part.

A further alternative, which is however less commonly applied, is the film riding seal with two suitable shaped engaging surfaces. As the turbine rotates a thin film of fluid is generated between the surfaces with a small lifting force to keep them apart. Typically an elastic element is included in the seal design to exert a restoring force, which reduces friction during start-ups and counters the lifting force and maintains an approximately constant gap between the sealing surfaces.

In the design of a turbine, particularly in case of retrofitting an existing old turbine with modern and more efficient subparts such as blades, the choice of how to mount seals is often limited. In some retrofits, it may not be possible or even desirable to mount the static part of the seal directly onto or otherwise rigidly connected to the casing of the turbine. The design described in the co-owned published United States patent publication no. 2008/0170939, incorporated by reference herein in its totality, may serve as an example to illustrate seal designs where the static part of the seal is not rigidly connected to the casing.

SUMMARY OF THE INVENTION

In an embodiment, the present invention provides a seal for reducing a fluid flow around tips of rotating blades of a turbine. A plurality of diaphragms are disposed in succession and provide an outer support for a radial arrangement of static blades disposed alternatingly with the rotating blades in an axial direction. An outer seal has axial and radial supports. The radial support includes a ring held in position by a key and a circumferential extension of the ring. The key and the circumferential extension have a clearance so as to allow a relative radial movement between the ring and a part of a casing or the plurality of diaphragms and providing a pressure sealing face and support in the axial direction. The ring includes a clearance from the at least one of a part of a casing and the plurality of diaphragms so as to be isolated from a radial dislocation in an event of a rotation movement of the part of the casing or the plurality of diaphragms.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
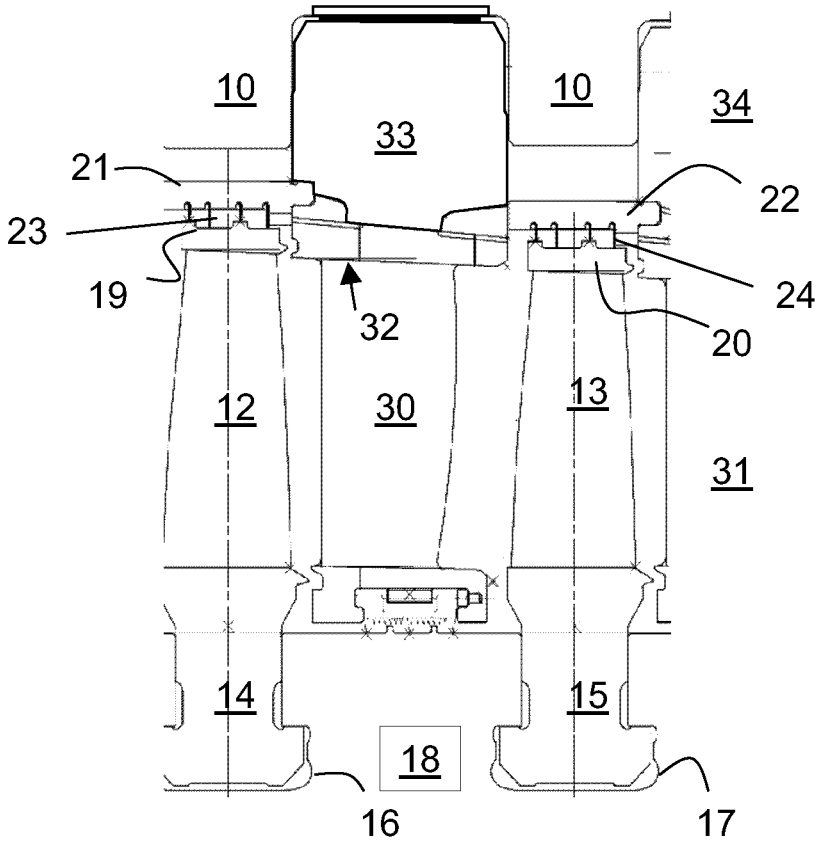
FIG. 1(Prior Art)
FIG. 1 shows a partial radial sectional view of two moving turbine blade rows, and a fully assembled turbine diaphragm in accordance with the invention, located between the moving blade rows.

It has now been found that, depending on the manner in which they are connected to the stator of the turbine, seals may suffer from dislocation or distortion which is caused by the force on the stator blades during fluid flow through the turbine. This dislocation typically results in a wider gap between the sealing surfaces and hence reduces the performance of the seal. Another dislocation leading to a widening of the seal gap may be the consequence of a deformation of the inner casing of the turbine. In an embodiment of the present invention the effects of these dislocations or deformations are reduced or removed.

In an embodiment of the present invention, a seal for a turbine is provided which includes successive diaphragms providing an outer support for a radial arrangement of static blades alternatingly arranged with radially and axially supported outer seal parts forming part of a seal reducing the flow of fluid around the outer ends of rotating blades, wherein the radial support of the outer seal part is formed as a ring held in position by keys and a circumferential extension in radial direction such that the keys and the circumferential extension have sufficient clearance to allow for a relative radial movement between the ring and the casing while proving a pressure sealing face and support in axial direction against the casing and wherein the ring has sufficient clearance from the casing and/or the diaphragms to be isolated from being radially dislocated in the event of a rotational movement of the diaphragms in axial direction (or in an axial plane). Isolated as used herein means essentially isolated.

In an embodiment, a sealing device is supported by or otherwise coupled with a diaphragm or diaphragm ring surrounding a radial arrangement of blades or aerofoils. The device can be advantageously applied in turbomachines. It is particularly relevant as a device to prevent leakage of fluid through the gap between rotating parts or aerofoils and the casing of turbines In an embodiment, the present invention provides an outer seal part for the sealing the tips of the rotating blades. The new outer seal part is designed to be less sensitive to a rotational movement of the stationary vanes or blades and the diaphragm or part of the casing connected to the stationary vanes. This rotational movement can occur when the stationary blades are subject to flow forces. The invention includes a stabilizing structure which supports the outer seal part in radial direction. Accordingly this stabilizing structure is formed as a ring keyed into the casing. The main body of the ring has sufficient clearance with respect to the upstream and/or downstream diaphragms. A diaphragm is defined herein as including any base parts of the stationary blades, or the inner extensions of the casing itself.

In an embodiment, the ring has an outer circumferential radially outwardly projecting extension or rim, which provides support in the axial direction of the turbine engaging with a juxtaposed face or edge of the casing. Alternatively, the circumferential extension can be radially inwardly projecting from the casing or any part connected to it such as the diaphragm. Both alternatives can provide an axial support for the ring.

However, it is important to note that the axial support in form of key and the circumferential extension are designed to allow a small radial movement of the ring against the casing in an embodiment. If, hence, the casing is distorted from its default shape by the flow forces or temperature differences, the ring is decoupled from the resulting distortion.

In a first preferred variant of the invention, the axial support is provided by a machined edge or groove in the outer circumference of the ring with an axially oriented face to contact a juxtaposed face in a matching groove or edge in the casing.

In a second preferred variant of the invention, the axial support is provided by a machined edge or groove in the outer circumference of the ring located within a gap between a diaphragm and the casing.

It can be beneficial to design the ring-shaped support as including an inner and an outer ring to facilitate installation and maintenance.

In an embodiment, it is possible to improve the performance of the seal further by mounting the outer seal face elastically, for example by springs. The elastic mounting maintains contacts between the seal faces, even if the gap between inner seal face on the tip of a rotating blade and the outer seal parts varies.

Aspects and details of examples of the present invention are described in further details in the following description referring first to a so-called "compact diaphragm" design as illustrated by FIG. 1, which reproduces the relevant features of FIG. 2 of above-cited patent publication '939. FIG. 1 is partial radial sectional sketch, showing a fully assembled diaphragm located between successive annular rows of moving blades 12, 13 in a steam turbine. The moving blades are each provided with radially inner "T-root" portions 14, 15 located in corresponding slots 16, 17 machined in the rim of a rotor drum 18. Their tips are also provided with radially outer elements referred to as shrouds 19, 20. In the example shown the shrouds carry the moving parts of a labyrinth seal. The circumscribing segmented rings, 21, 22 support the static part of the seal. These are rigidly connected to the upstream and downstream diaphragm rings 33, 34, which in turn are mounted within the casing 10 of the turbine. Sealing between the shrouds 19, 20 and the rings 21, 22 is accomplished by lips or fins 23, 24, which are caulked into grooves machined in the segmented rings 21, 22.

It is important to note that the segmented rings 21, 22 are supported by the diaphragm ring 33, 34, which in turn is welded to the bottom section of the stator blades 30, 31.

Figure 2A:
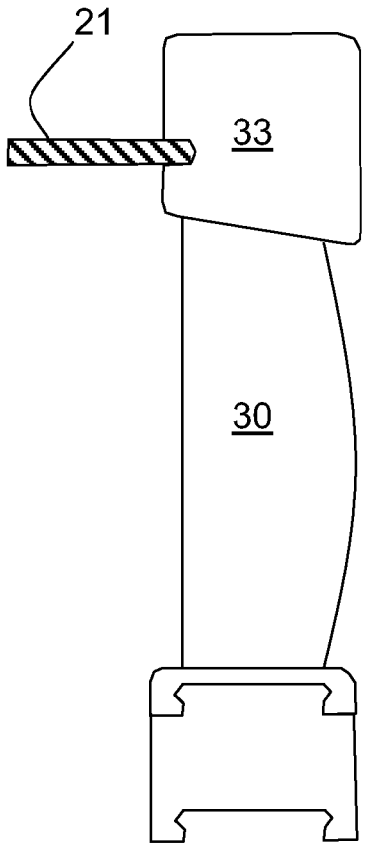
FIGS. 2A and 2B illustrate schematically the effect of axial rotation of a static blade on a supported seal
Figure 2B:
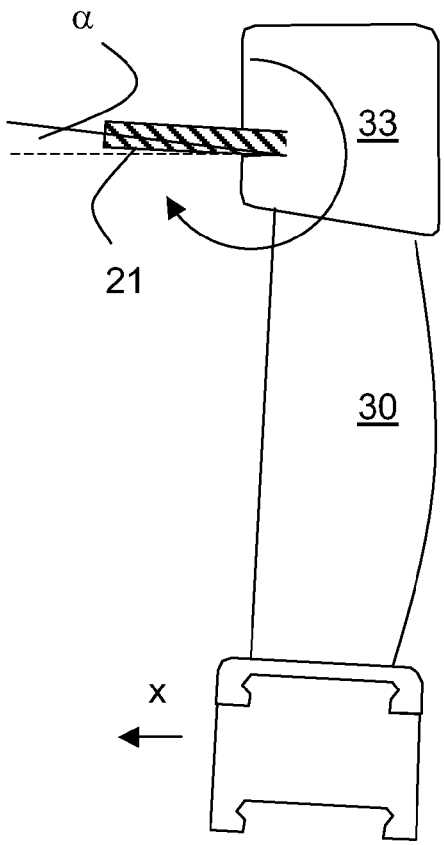

In operation the stator blades 30, 31 are subject to the flow through the turbine. The forces the flow transmits have various effects on the static parts of the turbine. The FIGS. 2A and 2B illustrate the effect of small rotation or bending movement of the static blades in axial direction using the example of a single blade. Like elements or elements with the same or like functions in FIG. 1 and in FIG. 2 are designated using the same numerals.

The assembly or default positions of the blade 30 and the seal support ring 21 are shown in FIG. 2 A. In FIG. 2 B the blade 30 is shown bent in direction of the flow causing a small rotational movement, which includes the diaphragm ring 33 and the seal support ring 21. The movement of support ring 21 is indicated in FIG. 2B by its maximal radial movement x and its rotation angle $\alpha$. The effect of this deflection on the tip leakage depends for a given turbine design on the specific geometry and other parameters, however, simulations show that the dislocation can increase the tip leakage area by to up to 30 percent or more. Even though the effect of the rotational movement is illustrated here using the example of stator blades mounted onto a diaphragm ring, it will be readily understood, that the same but perhaps less pronounced effect applies even when the stator blades are fixed directly to the casing as in other turbine designs.

Figure 3:
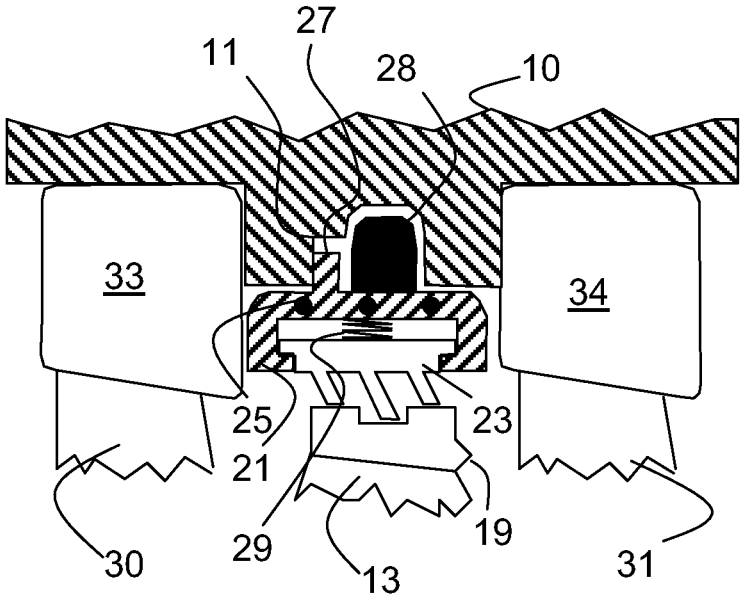
FIG. 3 is a schematic radial section illustrating a first embodiment in accordance with the invention.

A first exemplary device, which reduces tip leakage due to a rotational movement, is shown in FIG. 3. Again elements of FIG. 3 that appear already in identical or similar form in the above figures are denoted using the same numerals. In this example the seal support ring 21 is a rim-like structure with inwardly curved flanges providing radial and axial support for seal elements 23. The support ring 21 has clearance from the upstream and downstream diaphragm rings 33, 34. The support ring 21 is shown screwed at half joint using bolts 25. The ring 21 is keyed into the casing 10 with support keys 28 and sealed axially by a circumferential extension 27 of the ring projecting radially outwards. Kept in position within the chamber formed by the inwardly curved flanges of the ring 21 the seal elements 23 are backed by elastic elements 29, which act to maintain contact to the opposing face of the seal. The elastic elements 29 can include for example leaf springs. The opposing face is mounted onto the tip or shroud 19 of the rotating blade 13.

If the casing 10 is deformed for example by thermal stresses in radial direction, the outer circumferential extension 27 of the ring 21 has sufficient radial clearance within the matching circumferential groove 11 of the casing 10 to compensate for the resulting distortion. The gaps between the ring 21 and the diaphragm rings 33, 34 are sufficient to isolate it from the small rotations in axial direction as detailed in FIG. 2 above.

Figure 4:
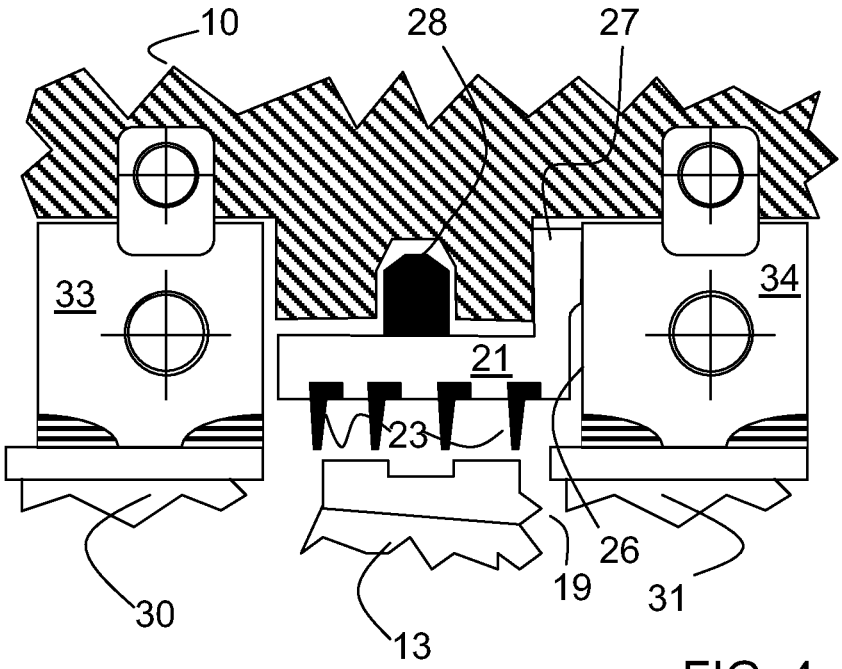
FIG. 4 is a schematic radial section illustrating a second embodiment in accordance with the invention.

A second exemplary device in accordance with the present invention is shown in FIG. 4. Again elements of FIG. 4 that appear already in identical or similar form in the above figures are denoted using the same numerals. In this example the seal support ring 21 is shown having an L-shaped cross-section. An outer circumferential edge 27 of the ring 21 extends into the gap between the upstream diaphragm ring 34 and the casing 10. This extended seal support ring 21 of this example is keyed into the casing 10 and bolted at its joints as in the example above. A circumferential cut 26 provides a gap between the (radially) inner seal-bearing part of the ring 21 and the diaphragm 34 and allows the diaphragm 34 to rotate without forcing the ring 21 to follow its radial movement.

Figure 5A:
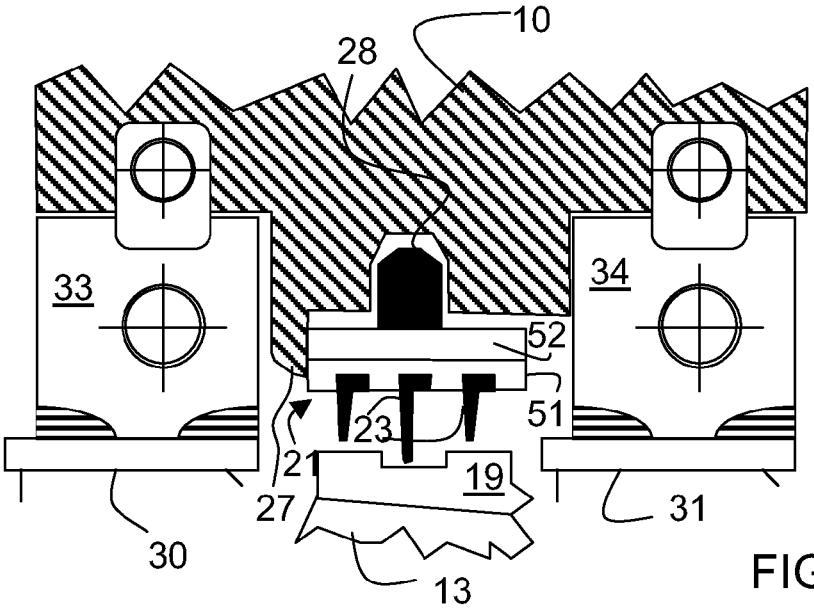
FIGS. 5A and 5B show an axial and a radial cross-section, respectively, illustrating a third embodiment in accordance with the invention.
Figure 5B:
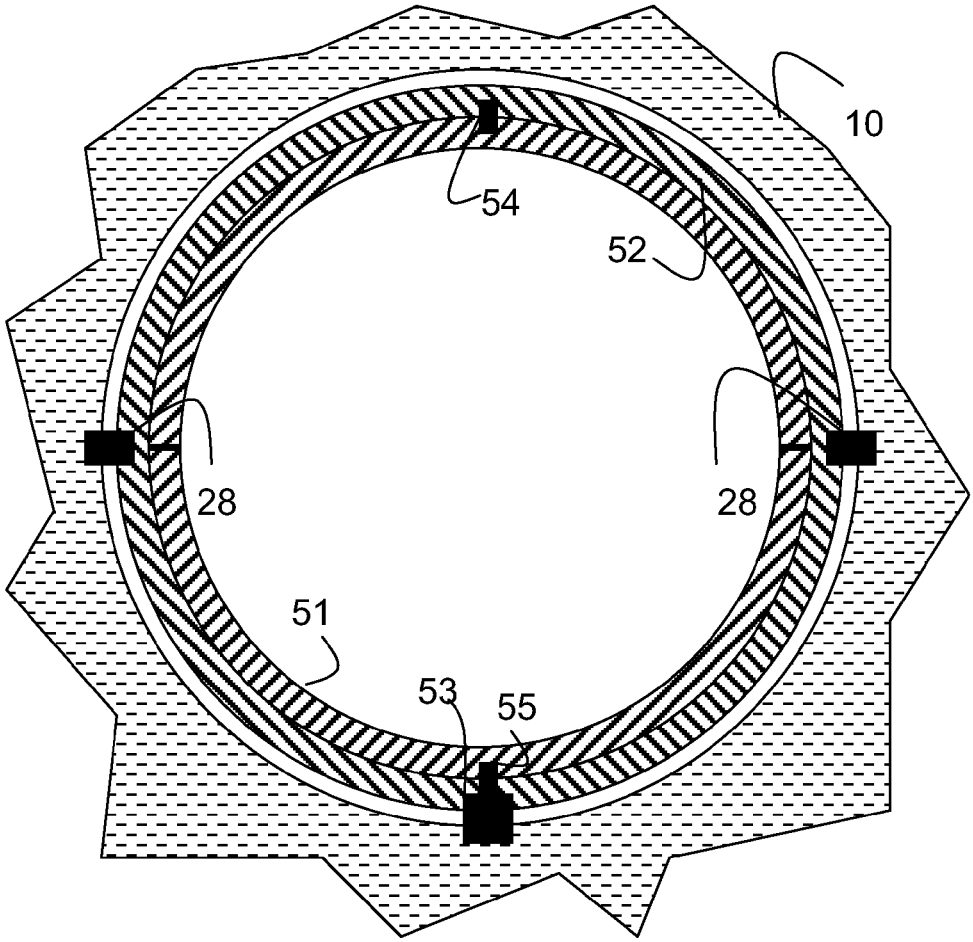

In a third example as shown in FIGS. 5A and 5B, the support ring provides directly a pressure seal in axial direction by engaging with an axially oriented face or edge on a radially inwardly projecting part 27 of the casing 10. As this extended part of the casing is not subject to the rotation of the stator blades 30, 31 or the diaphragm rings 33, 34, the ring 21 is again isolated from the effects of such a rotation. In the example the ring is keyed in with keys 28 as in the previous examples. However, to facilitate its installation, the ring 21 of FIG. 5 is split into an inner and an outer ring 51, 52, respectively. The inner ring 51 carries the seal 23. A transverse key 53 prevents rotation of the whole ring structure around the central axis of the turbine, while the transverse pins 54, 55 prevent a rotation of the inner ring 51. Keys such as the transverse key 53 can also be applied to secure the ring in the examples as described above.

The present invention has been described above purely by way of example, and modifications can be made within the scope of the invention. For example the stator blades can be directly mounted onto inner radial extensions of the casing instead of diaphragm rings. Then the seal support ring will be separated by gaps from such extension.

The invention also consists in any individual features described or implicit herein or shown or implicit in the drawings or any combination of any such features or any generalisation of any such features or combination, which extends to equivalents thereof. Thus, the breadth and scope of the present invention should not be limited by any of the above-described exemplary embodiments. Each feature disclosed in the specification, including the drawings, may be replaced by alternative features serving the same, equivalent or similar purposes, unless expressly stated otherwise.

Unless explicitly stated herein, any discussion of the prior art throughout the specification is not an admission that such prior art is widely known or forms part of the common general knowledge in the field.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE SIGNS AND NUMERALS casing 10
circumferential groove of the casing 11
moving blades 12, 13
radially inner "T-root" portions 14, 15
corresponding slots 16, 17
rotor drum 18
shrouds 19, 20
seal support rings, 21, 22
support keys 28
seal fins/seal element 23, 24
bolts 25
circumferential cut 26
circumferential extension in radial direction 27
elastic elements 29
stationary blades 30, 31
upstream and downstream diaphragm rings 33, 34
inner and outer support rings 51, 52
transverse key 53
transverse pins 54, 55
maximal radial movement x
rotation angle $\alpha$

What is claimed is claimed:

1. A seal for reducing a fluid flow around tips of rotating blades of a turbine, the seal comprising:

a plurality of diaphragms disposed in axial succession and providing an outer radial support for a radial arrangement of static blades disposed alternatingly with the rotating blades in an axial direction;

a radially inner seal bearing part;

a radially outer seal part having axial and radial supports, wherein a ring is located between an axial upstream and axial downstream diaphragm and has a radial support that includes a key and a circumferential extension of the ring, the key and the circumferential extension having a clearance so as to allow a relative radial movement between the ring and a part of a casing or the plurality of diaphragms and providing a pressure sealing face and support in the axial direction between the ring and the casing, and wherein the ring includes a clearance from at least one of the part of the casing and the plurality of diaphragms so as to be isolated from a radial dislocation in an event of a rotation movement of the part of the casing or the plurality of diaphragms; and wherein the axial support is an extension of the outer circumference of the ring and includes an axially oriented face contacting a juxtaposed face in a matching groove in the casing.

2. A seal for reducing a fluid flow around tips of rotating blades of a turbine, the seal comprising:

a plurality of diaphragms disposed in axial succession and providing an outer radial support for a radial arrangement of static blades disposed alternatingly with the rotating blades in an axial direction;

a radially inner seal bearing part;

a radially outer seal part having axial and radial supports, wherein a ring is located between an axial upstream and axial downstream diaphragm and has a radial support that includes a key and a circumferential extension of the ring, the key and the circumferential extension having a clearance so as to allow a relative radial movement between the ring and a part of a casing or the plurality of diaphragms and providing a pressure sealing face and support in the axial direction between the ring and the casing, and wherein the ring includes a clearance from at least one of the part of the casing and the plurality of diaphragms so as to be isolated from a radial dislocation in an event of a rotation movement of the part of the casing or the plurality of diaphragms; and wherein the axial support is an extension of the outer circumference of the ring disposed in a gap between one of the plurality of diaphragms and the casing.

3. A seal for reducing a fluid flow around tips of rotating blades of a turbine, the seal comprising:

a plurality of diaphragms disposed in axial succession and providing an outer radial support for a radial arrangement of static blades disposed alternatingly with the rotating blades in an axial direction;

a radially inner seal bearing part;

a radially outer seal part having axial and radial supports, wherein a ring is located between an axial upstream and axial downstream diaphragm and has a radial support that includes a key and a circumferential extension of the ring, the key and the circumferential extension having a clearance so as to allow a relative radial movement between the ring and a part of a casing or the plurality of diaphragms and providing a pressure sealing face and support in the axial direction between the ring and the casing, and wherein the ring includes a clearance from at least one of the part of the casing and the plurality of diaphragms so as to be isolated from a radial dislocation in an event of a rotation movement of the part of the casing or the plurality of diaphragms; and wherein the axial support is an extension of the inner circumference of the casing and includes an axially oriented face contacting a juxtaposed face in a matching groove or edge of the ring.

4. A seal for reducing a fluid flow around tips of rotating blades of a turbine, the seal comprising:

a plurality of diaphragms disposed in axial succession and providing an outer radial support for a radial arrangement of static blades disposed alternatingly with the rotating blades in an axial direction;

a radially inner seal bearing part;

a radially outer seal part having axial and radial supports, wherein a ring is located between an axial upstream and axial downstream diaphragm and has a radial support that includes a key and a circumferential extension of the ring, the key and the circumferential extension having a clearance so as to allow a relative radial movement between the ring and a part of a casing or the plurality of diaphragms and providing a pressure sealing face and support in the axial direction between the ring and the casing, and wherein the ring includes a clearance from at least one of the part of the casing and the plurality of diaphragms so as to be isolated from a radial dislocation in an event of a rotation movement of the part of the casing or the plurality of diaphragms; and wherein the ring includes an inner ring and an outer ring fitted together in the casing and secured against a relative rotation.

5. The seal as recited in claim 1, wherein the ring includes a radially acting elastic element configured to close a gap between the outer seal part and a seal part disposed on a tip of one of the rotating blades.

6. The seal as recited in claim 1, comprising:

seal fins.

7. The seal as recited in claim 2, wherein the ring includes a radially acting elastic element configured to close a gap between the outer seal part and a seal part disposed on a tip of one of the rotating blades.

8. The seal as recited in claim 2, comprising:

seal fins.

9. The seal as recited in claim 3, wherein the ring includes a radially acting elastic element configured to close a gap between the outer seal part and a seal part disposed on a tip of one of the rotating blades.

10. The seal as recited in claim 3, comprising:

seal fins.

11. The seal as recited in claim 4, wherein the ring includes a radially acting elastic element configured to close a gap between the outer seal part and a seal part disposed on a tip of one of the rotating blades.

12. The seal as recited in claim 4, comprising:

seal fins.

* * * * *